United States Patent [19]

Pownall

[11] 4,095,400

[45] Jun. 20, 1978

[54] SPINNING MACHINE

[75] Inventor: Arthur Robert Glen Pownall, Masterton, New Zealand

[73] Assignee: Development Finance Corporation of New Zealand, Wellington, New Zealand

[21] Appl. No.: 803,944

[22] Filed: Jun. 6, 1977

[51] Int. Cl.[2] ..... D01H 1/00; D01H 1/28; D01H 7/50

[52] U.S. Cl. ..... 57/37; 19/114; 57/66; 57/106

[58] Field of Search ..... 57/37, 66, 66.5, 74, 57/106, 127; 242/158.4 A; 19/98, 114

[56] References Cited

U.S. PATENT DOCUMENTS

| | | | |
|---|---|---|---|
| 506,754 | 10/1893 | Weiss | 57/66 |
| 3,067,568 | 12/1962 | Hauguitz | 57/66 |
| 3,332,634 | 7/1967 | Somervell et al. | 242/158.4 A |

*Primary Examiner*—Richard C. Queisser
*Assistant Examiner*—Charles Gorenstein
*Attorney, Agent, or Firm*—Cantor and Singer

[57] ABSTRACT

This spinning machine weighs about 10 lbs. and is of about the size of a one foot cube. The reel on which the spun yarn is to be stored is contained within a large horizontal tube. The yarn is fed through a hole in the wall of the tube from a groove on the outer surface. The reel is rotated by running on the inner surface of the tube which is driven by, for instance, a sewing machine motor. By control of dimensions or by braking a relative speed is imposed between the reel and the tube and is the speed for reeling yarn. The yarn is fed to the groove from two small tubes, one stationary and the other rotating with the large tube. Both are coaxial with the large tube. Locks or sliver to be spun are presented to a surface with saw-tooth corrugations alternating with slots, and is fed to the stationary small tube.

11 Claims, 12 Drawing Figures

SPINNING MACHINE

BACKGROUND OF THE INVENTION

This invention relates to a spinning machine, in particular to a machine for home spinning of wool and other fibres. The discussion and description of the invention will refer to wool, but the changes that are needed to apply the invention to other fibres, natural and synthetic, are obvious to those skilled in the art.

The invention relates to a machine which combines the key operations of carding raw greasy wool as well as scoured wool, wool tops and slivers, and subsequently spinning the resultant band of carded or combed wool into yarn. In particular this invention relates to a device suitable for use in the home or in cottage type industry in developing countries for the purpose of conveniently and quickly processing wool fibres into yarn of the type known as home or hand-spun yarn which is currently being sold at a premium in world markets through being said to have been spun in natural wool grease.

To prepare raw wool for use in weaving, there are two principal steps. Firstly the individual strands are separated and laid approximately parallel to each other in a band. This can variously be called carding, combing or drawing out, and the result is sliver. Secondly, the band is twisted (spun) into a yarn, which, unlike the band from which it is formed, has a considerable tensile strength.

Wool fibres growing on the back of sheep are intimately associated with an animal fat known variously as lanolin, lanum, hydrous wool fat and by other names. This substance, consisting chiefly of cholesterol and isocholesterol esters of the higher fatty acids, imparts important water shedding as well as thermal insulating and dirt resistant properties to raw fleece wool. The unctuous and sticky nature of wool fat results in clogging and inefficiency in machines currently used for commercially carding wool so that normal practice requires raw wool to be scoured and washed prior to carding, and to be subsequently re-oiled as sliver in order to be spun. Normal commercial practice in large scale spinning therefore requires two additional operations, scouring and re-oiling, not necessary if wool fibres could be carded in the natural wool fat. In addition the removal of the wool fat results in the loss of some water shedding, thermal insulating and dirt repelling properties in the finished yarn. For carding in conjunction with traditional wheel spinning, considerable skill is needed, if a steady and regulated amount of sliver is continuously to be fed to the spinning head. In the absence of sufficient skill, the yarn produced is uneven.

It is an object of the present invention to provide a spinning machine which will go some way to overcoming the aforementioned difficulties in handling unscoured or unwashed wool both for home and commercial use, as well as effecting improvements in overcoming the aforementioned difficulties in small scale spinning, or will at least provide the public with a useful choice.

BRIEF SUMMARY OF THE INVENTION

Briefly the invention contemplates a spinning machine including a tube which contains a reel on which yarn when spun is to be reeled. The yarn is fed to the reel through a hole in the wall of the tube. It is fed to the hole from a tubular guide fixed on the axis of the tube and co-operating with a corresponding fixed tubular guide into which sliver is fed. The tube is rotated, and relative motion between the two guides supplies the twist needed for spinning. The reel is rotated, at a speed different from that of the tube, by rolling on the inner surface of the tube. The difference of speeds supplies the relative rotation between tube and reel that is needed for reeling the yarn. This difference of speed may be controlled by the tightness with which the operator holds the yarn as it is spun, or by a brake. The machine is small, so that it can be used in a small room or a crowded flat, and it produces even yarn more easily than does a spinning wheel, and it does it more quickly. It will handle fleece wool in the greasy state.

A carder of fleece wool may be incorporated. It consists of an array of plates, serrated on an edge, and assembled in a block whose midline is continuous with the entry to the fixed guide.

BRIEF DESCRIPTION OF THE DRAWINGS

In order that the invention may be more readily understood and carried into effect, reference is made to the accompanying drawings which, together with their description, are offered by way of example only and are not to be taken as limiting the invention, the scope of which is defined by the appended claims rather than any preceding description.

In the drawings.

DETAILED DESCRIPTION OF THE INVENTION

Figure 1:
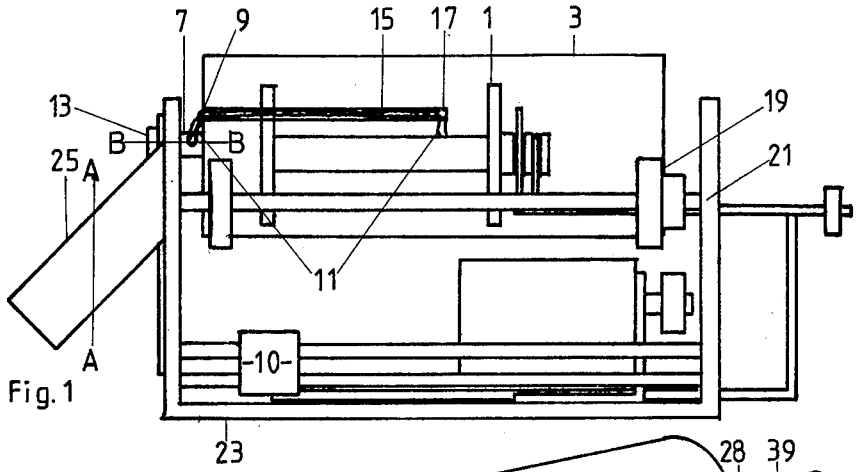
FIG. 1 is an elevation from a side view of one embodiment of the invention.

The first part of the description relates to spinning only; carding is introduced later.

In spinning, a loose band of more or less parallel fibres called a sliver is twisted into a yarn which is of very considerable length, and is conveniently stored on a cop or reel. A machine for spinning must provide three relative motions; a fast twist between sliver and yarn; a slower rotation of the reel on its axis to take up the yarn as it is formed, and a traverse of the yarn to and fro along the length of the reel to lay the yarn in layers as it is wound.

In the present machine the reel is contained within a tube of circular cross section which rotates about its axis near a feed arrangement for the sliver which does not rotate. This provides the spinning twist. The reel is carried round by the contact of its rim with the inner surface of the tube, with which the reel is approximately coaxial. Because the reel is smaller in diameter than the bore of the cylinder on which it rolls its speed of rotation, if free, is greater than the speed of rotation of the cylinder. It has been found satisfactory to make the reel diameter four fifths of the bore of the cylinder. Alternatively the speed of the reel may be controlled by a light brake. This provides a rotation relative to the tube and is the motion which winds the yarn on the reel. The reel is oscillated along its axis within the tube. This is the layering motion.

Although size is by no means an essential of this invention, it will be assumed for convenience of description that a reel 1 that is 12cm between cheeks and 7.2cm in diameter is to be filled. The reel lies approximately axially within a circular tube 3 of bore 9cm and length 25cm. The tube can conveniently be made of a clear plastic. One end is open, and the other end has fixed to it axially (conveniently by fixing in a closed end 5) a tube 7 of bore about 5mm. The tube projects about 2cm beyond the end of the tube of the large bore and has a transverse hole 9, communicating with the bore of the small tube, about 5mm out from the end of the large tube. Small tube 7, from its outer end and including transverse hole 9, forms a passageway for yarn 11, and is well smoothed and rounded. The outer end of small tube 7 projects towards the means 14 which feed sliver, and the spinning process takes place within the tube, and in the space between it and fixed tube 13.

Yarn is led from transverse hole 9 to the outer surface of large tube 3 where a groove 15 parallel to the axis leads the yarn to the mid-length of tube 3, to a hole 17 which penetrates to the interior of tube 3, and onto reel 1.

Large tube 3 with its contents is to be rotated to provide the spinning motion. The tube rests on two or more rollers 19 parallel to the axis of the tube. The rollers are rotated in phase by, for example, belt drive from an electric motor such as a sewing machine motor, controlled at variable speed by a foot control. Rollers 19 form a well known method of driving a tube, and it is known art to construct them so that they have enough friction with the tube without scratching the surface of the plastic. Clearly yarn 11 in passing along the length of tube 3 must not catch on drive rollers 19. It has been found that, if groove 15 is about 3mm wide and 3mm deep, the yarn runs free.

Yarn 11 is fed into the large tube 3 and towards the reel which is coaxially within tube 3, resting by its rims on the inner surface of tube 3. Clearly reel 1 will tend to be rotated as tube 3 is rotated. By means to be described later the reel is caused to rotate at a speed different from that of tube 3, and therefore different from that of yarn 11 which is held by tube 3. Yarn 11 will be wound on reel 1.

Projecting into the open end of tube 3 (i.e. at the end opposite from the feed of sliver) and connected to reel 1 is a linkage. It could be arranged as a cord and spring, but it has been found convenient to make it a rod 28 approximately coaxial with reel 1. Rod 28 is oscillated along its length by the length of the winding space on reel 1 at such a speed relative to the rotation of the reel that yarn 11 is wound in compact layers. Many methods of producing this oscillation are possible. In one, a cam is driven through suitable gearing or belts from electric motor 8, and a cam follower, held to the cam by a spring, is connected through a linkage to the rod to be oscillated.

Figure 5:
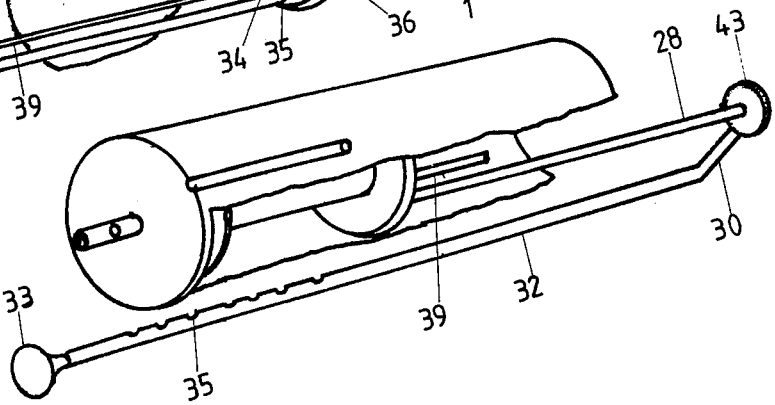
FIG. 5 is a broken away view from the front to show other aspects of the means for moving the reel axially.
Figure 7:
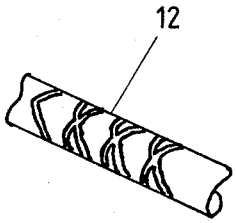
FIG. 7 is a detail of another variant of FIG. 6.
Figure 6:
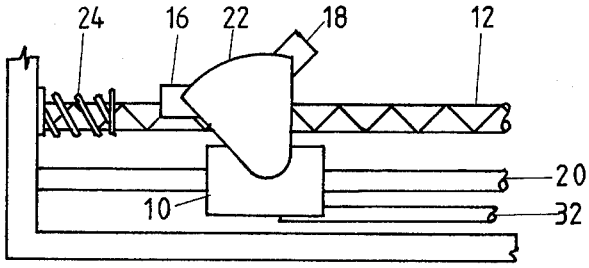
FIG. 6 is an enlarged view of a part of FIG. 1 to show one variant of a second arrangement for moving the reel axially.

In an alternative method shown in FIGS. 1, 6 and 7 motor 8 drives a feed rod 12 which has left and right hand threads. In FIG. 1 a general arrangement is shown, with block 10 representing schematically the two variants of FIGS. 6 and 7. In FIG. 6 two tumbling half-nuts 16 and 18 are mounted on sector plate 22 which pivots on block 10, which slides on guide rod 20, and drives a shortened version of the rod 32 shown in FIG. 5. The rotation of the feed rod causes the half-nut which is engaged with it to move towards one end of the feed rod, where the tumbling half-nut 16 hits a stop 24 which disengages the first half-nut and engages a second half-nut so that the direction of feed of the reel is reversed. It is possible to ensure positive engagement and disengagement of the half-nuts by a permanent magnet spring arrangement. A half-nut is held into engagement with the threaded rod by a small permanent magnet, which may be the half-nut itself and the disengaging stops 24 are sprung so that movement towards a stop puts a disengaging force on the tumbling half-nut which is engaged. When the spring tension becomes greater than the retaining force of the magnet the tumbling action is carried through by the positive action on the stored energy of the system. The magnet of the half-nut that is now to be engaged assists with this movement and subsequently holds the second half-nut in position while traversing the length of the feed rod in the opposite direction.

The tumbling half-nuts can be dispensed with if the feed rod 12 has the endless, two-directional thread shown in FIG. 7.

Figure 2:
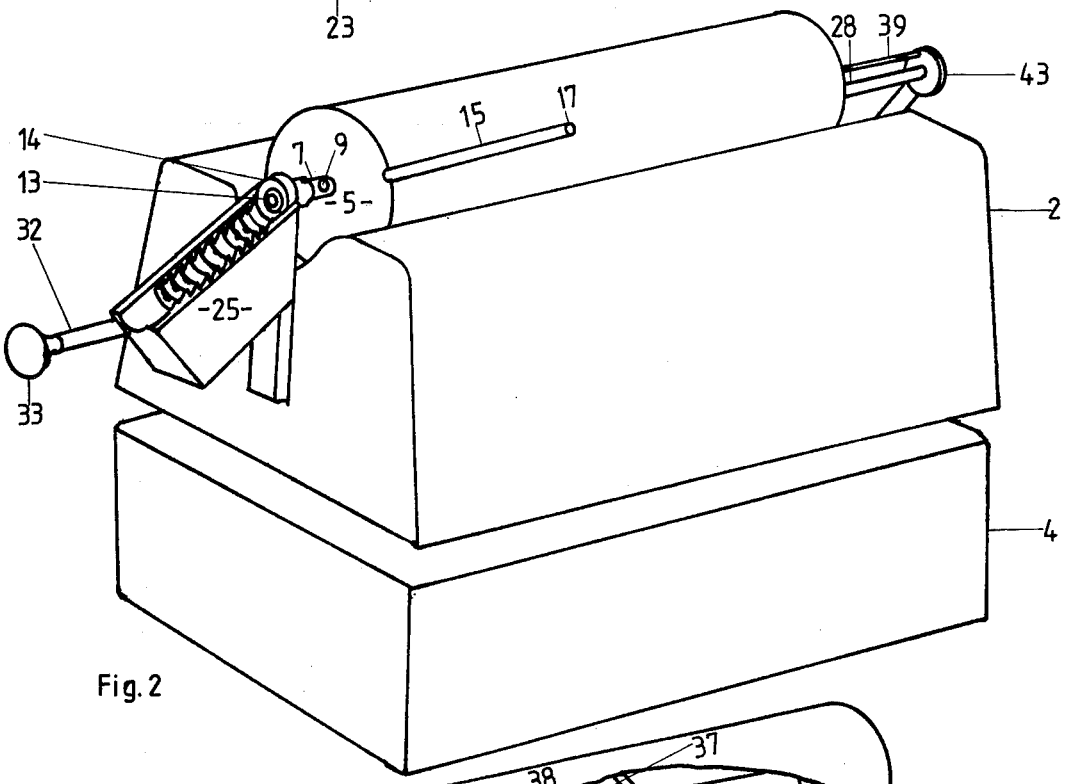
FIG. 2 is a simplified perspective view of a second embodiment of the invention.
Figure 4:
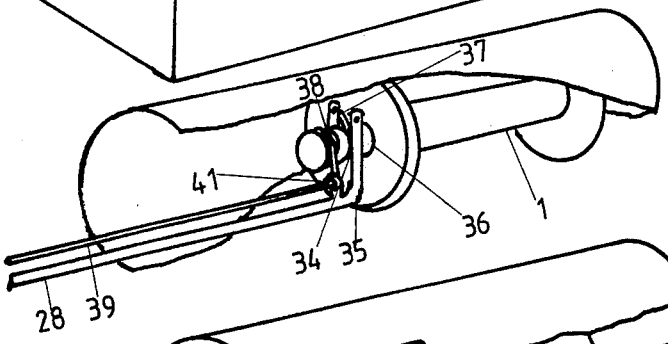
FIG. 4 is a broken away view, from the back as seen in FIG. 2, to show one arrangement for moving the reel axially and for braking it.

A simpler form of control of the axial movement of the reel 1 is shown in FIGS. 2, 4 and 5. The inner end of rod 28 carries a fork 35 which runs in a groove 34 in an axial projection 36 from reel 1. Any longitudinal movement of rod 28 will cause reel 1 to move axially. The remote end of rod 28 is rigidly attached, for instance by cross bar 30, to rod 32 which is parallel to rod 28 and is brought out, in a position convenient to the operator's hand, to the front of the base 2 of the spinning machine, where it is fitted with a knob 33. Rod 32 has a number of notches 35 where it passes through base 2. A spring-loaded detent (not shown) is fixed to the base and engages lightly one of notches 35. As the operator spins, knob 33 is pushed or pulled to move reel 1 at an intermittent speed that will cause yarn 11 to wind uniformly on reel 1.

Reel 1, being smaller than cylinder 3 in which it rolls, will when free rotate faster than the cylinder and therefore will wind yarn 11 on reel 1. But the reel is not free. The operator causes the sliver to be spun by holding it back against the tendency of the spinning machine to take it through fixed guide 13. This causes tension in yarn 11 right up to its contact with reel 1, and therefore slows down reel 1 and controls the rate of winding. This method needs some degree of skill because too much tension in yarn 11 will cause reel 1 to slow down to the speed of cylinder 3 so that no yarn is wound.

Figure 8:
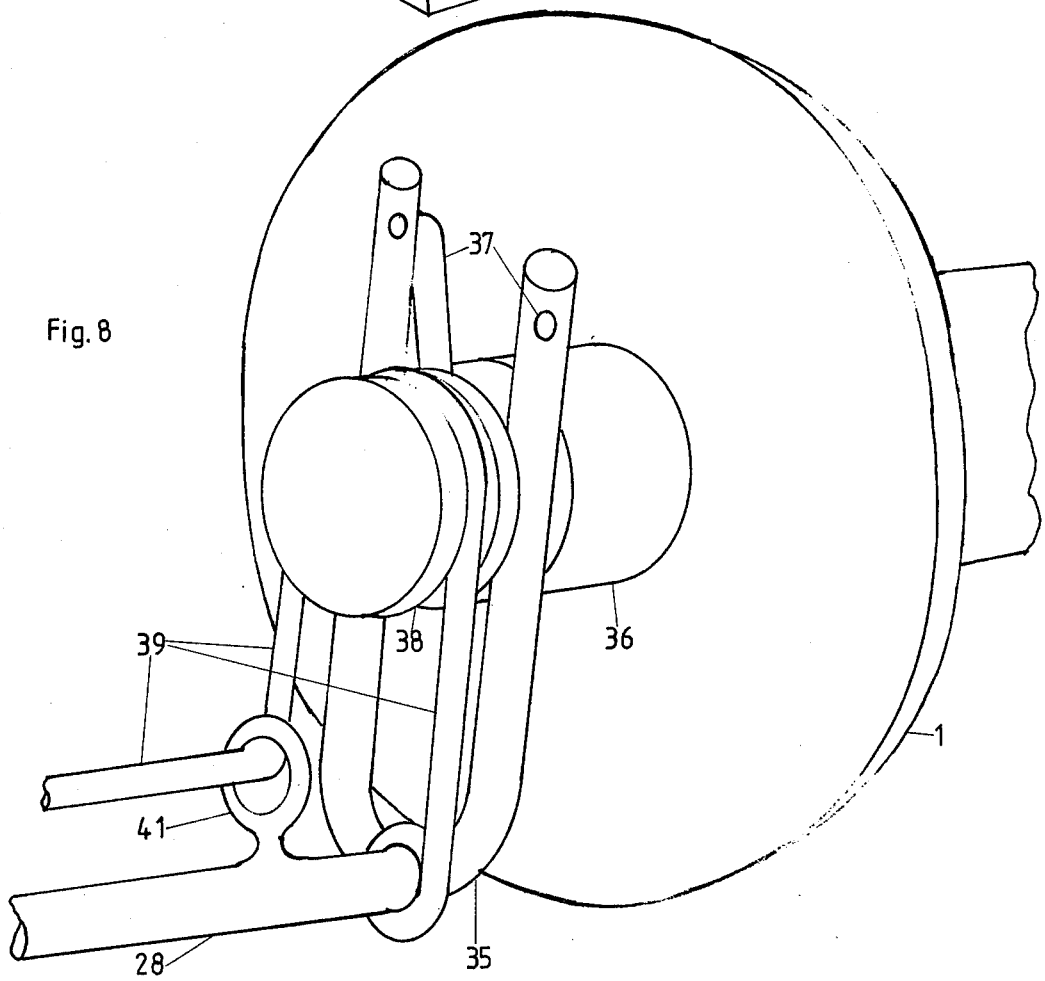
FIG. 8 is an enlarged view of a part of FIG. 4 to show the braking arrangements in more detail.

An alternative method of controlling the speed of reel 1 is shown in FIGS. 4 and 8. Rod 28, as already stated, engages at its inner end with an axial grooved projection from reel 1. From fork 35 is slung a loop 37 of cord as shown in FIG. 8. Engaging with a further groove 38 of projection 36 is a cord 39, anchored to rod 28, and passing through an eye 41 on it. Wheel 43 is a diagrammatic representation of a means, which could be a screwed rod working in a saddle, of tightening cord 39. Loop 37 pressing upwards and cord 39 pressing downward co-operate to form a brake on reel 1. They are also arranged to hold reel 1 against the inner surface of tube 3.

When reel 1 is fitted with a brake, it will normally rotate slower than cylinder 3. The tension of yarn 11 can still be used as a fine adjustment of the speed of the reel, but the effect is now different. The unbraked reel normally rotates faster than the cylinder, and the braked reel normally slower. Increasing the yarn tension on an unbraked reel will cause the rate of reeling of yarn to decrease. Increasing the tension with a braked reel will cause the rate of reeling of yarn to increase.

Figure 3:
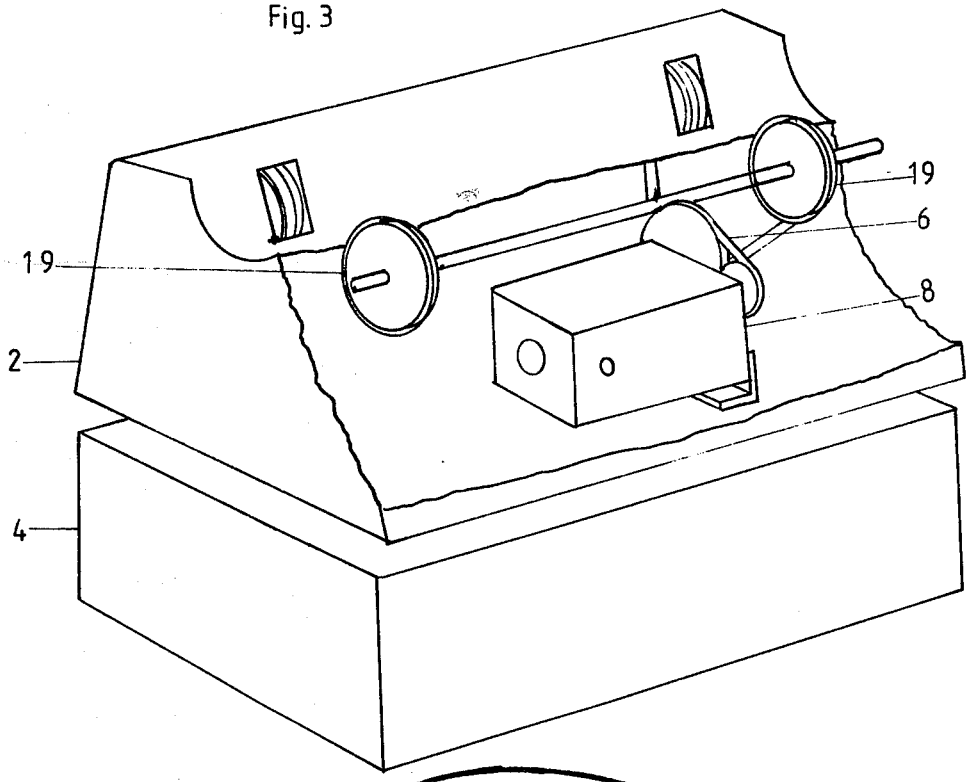
FIG. 3 is similar to FIG. 2 but with parts broken away to show the driving arrangement.

Rollers 19 may be supported in many ways. FIG. 1 shows one possible method, based on a frame constructed by known means. FIGS. 2 and 3 show another possible method, based on a moulding. Clearly rollers 19 must be carried in bearings 21. In the pattern of FIG. 1 these can be supported from a base plate 23. Motor 8 and its associated gearing or belts 6 and any oscillation drive that is used can be accommodated on the base plate and be covered. The working parts are still more completely covered in the design shown in FIG. 2.

The general design as shown in FIGS. 1 and 2, especially that in FIG. 2, are arranged to pack away neatly. The carder 25 is held by a tongue and groove arrangement; cylinder 3 lifts off; rod 32 can be telescopic and in two parts held together in use by a spring clip so that, when brake cord 39 is released, rods 28 and 32 can be lifted off. The various loose parts can be stored in sub-base 4, clipped to base 2 or, for FIG. 1, on base 23.

One effect of the tension in yarn 11 has already been referred to. A second effect is that the whole of the rotating system is pulled towards the fixed support for the sliver. To deal with this, the sliver support ends in fixed guide 13 which is a tube corresponding to and in line with tube 7 (the first guide) by which yarn 11 enters the rotating system. The first guide 7 is on the axis of rotation of tube 3, so that yarn 11 in entering it moves only in rotation, and not in translation. The first or rotating guide 7 can therefore press against the second or fixed guide 13 without interfering with the movement of the yarn during the spinning process, and second guide 13 can function as a stop for the rotating part of the spinning machine. Since the sliver must pass through the tube which is the second guide, this must be smooth and well rounded. It would normally be a straight tube, but it may include a bend.

Figure 10:
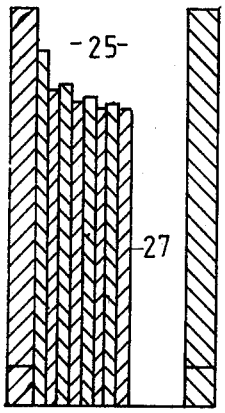
FIG. 10 is a cross section at A A in FIG. 1 of the carder.
Figure 9:
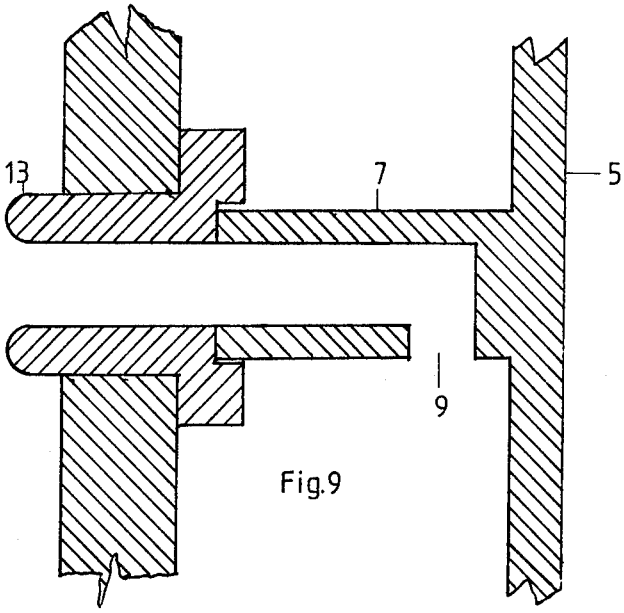
FIG. 9 is an enlarged cross sectional view of the fixed and rotating guides on the line B B in FIG. 1.
Figure 11A:
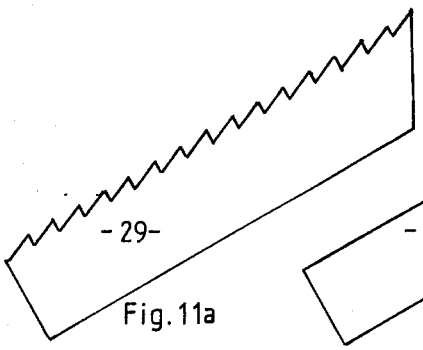
FIG. 11*a* and 11*b* are side views of alternate leaves of the carder of FIG. 10.
Figure 11B:
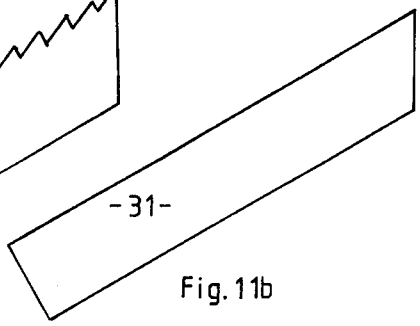

If the operator wishes, the sliver can be presented to second guide 13 by hand, but it is considered that a new form of feed arrangement 25, shown in FIGS. 1 and 2, and in detail in FIGS. 10 and 11*a* and 11*b*, leads to a better yarn. Leading to the entrance to second guide 13 is a carding comb 27 which is formed of segments, some of which are sawtooth and are arranged so that movement towards guide 13 is not much impeded but movement away from it is impeded. Comb 27 may be flat, or it may form, as in FIG. 10, a channel leading towards guide 13, and the channel may decrease in cross section towards guide 13.

It is possible for it to begin as flat and to develop into a channel towards the guide.

Two forms of carding comb have been found satisfactory, one static and the other driven. Both are based on a construction using a stack of sheets, in which the sawteeth are formed on an edge on some or all of the sheets. The static form is cheaper to make, and is more easily adapted to a channel shape. In it teeth 29 as in a saw are cut on one edge of a number of sheets of a material which may be a plastic about 0.5mm thick, 10cm long, and any convenient width for clamping the sheets together. The sheets are assembled with the teeth aligned, and interposed are sheets 31 with smooth edges so assembled that the smooth edges are on the level of the bottom of the sawteeth. It may be an advantage if the smooth sheets are thinner than those with tooth edges, or if the toothed and smooth sheets are in a ratio greater than one. The total width of the stack of sheets should be approximately 2cm. It is found that when a lock of fibrous material is pulled over this device the fibres when aligned fall into the channels formed between the teeth by the intervening smooth edges.

In the second form of carding comb (not shown) there are once more two sets of sheets, of approximately the same dimensions as in the static form, but both sets are now tooth-edged. The two sets are again intermeshed, but each set is caused by cams or other means to lift, move forward, subside, and so move back and fro cyclically. The two sets move in antiphase. There is thus a continuous movement forward of the teeth that are in contact with the sliver. The teeth may be driven from the electric motor that drives the rollers.

The delivery end of either tooth device is presented to the entry to the fixed or second guide 13, whether this is in line with the axis of the reel 1, or is at an angle. The general axial line of the teeth, that is to say the working edge of the middle sheet, may be in line with the axis of the entry of the second guide 13, or it may feed upwards at an angle that may be as much as 45°.

Compared with the spinning machines used in mills, the present machine is very much cheaper and very much more compact.

Compared with a spinning wheel, it is more compact, an advantage in flats and small houses, it is completely safe, since dangerous moving parts can be covered, it has a reel with a large capacity, it spins continuously, it is easy to feed raw wool through the carder, and less judgement is needed since the wool on the carder is static.

What I claim is:

1. A spinning machine including a reel adapted to receive yarn after spinning, a hollow cylinder surrounding and approximately co-axial with said reel, a base including rotatable means on which said cylinder rests, a first guide fixed axially to and projecting from the end of said cylinder and adapted to guide the yarn after spinning, a second guide held without rotation by said base in line with said first guide and adapted to guide the yarn, sliver or partly spun sliver towards the first guide, means for rotating the cylinder and the first guide relative to the second guide, means for rotating the reel relative to the cylinder and including a carding comb held by said base with one end of said comb adjacent to the second guide whereby the fibres to be spun are carded while being fed to the second guide.

2. A spinning machine as claimed in claim 1 wherein the carding comb comprises a stack of sheets of solid material, the middle member of which is co-planar with the axis of the second guide, and at least some of the sheets have sawteeth formed on an edge, the stack being so assembled that the tips of the sawteeth lie on a planar or curved surface.

3. A spinning machine including a reel adapted to receive yarn after spinning, a hollow cylinder surrounding and approximately co-axial with said reel, a base including rotatable means on which said cylinder rests, a first guide fixed axially to and projecting from a first end of said cylinder and adapted to guide the yarn after spinning, a second guide held without rotation by said base in line with said first guide and adapted to guide the yarn towards the first guide, means for rotating the cylinder and the first guide relative to the second guide, and means for rotating the reel relative to the cylinder, wherein the reel has at least one rim in contact with the inner surface of the cylinder, and the cylinder in rotating causes the reel to roll on its at least one rim on the inner surface of the cylinder, whereby the speed of rotation of the reel about its axis differs from the speed of rotation of the cylinder.

4. A spinning machine as claimed in claim 3 including means by which an electric motor drives the cylinder and the first guide about their common axis at a controllable speed.

5. A spinning machine as claimed in claim 3 wherein the first end of the cylinder is closed, and the first guide comprises a tube inset at the centre of the closed end.

6. A spinning machine including a reel adapted to receive yarn after spinning, a hollow cylinder surrounding and approximately co-axial with said reel, a base including rotatable means on which said cylinder rests, a first guide fixed axially to and projecting from a first end of said cylinder and adapted to guide the yarn after spinning, a second guide held without rotation by said base in line with said first guide and adapted to guide the yarn towards the first guide, means for rotating the cylinder and the first guide relative to the second guide, means for rotating the reel relative to the cylinder and traversing means for moving the reel cyclically parallel to its length, whereby the yarn is laid in layers on the reel, said traversing means including an adjustable brake, whereby the speed of rotation of the reel about its axis is different from the rate of rotation of the cylinder by an amount that is adjustable.

7. A spinning machine as claimed in Claim 6, including an axial projection attached to the reel on its end which faces the second end of the cylinder, at least one circumferential groove on the projection, a fixed loop of flexible material underlying the projection and a tensionable cord, anchored to a stationary anchorage and lying in a groove, whereby the loop of flexible material and the cord co-operate to form an adjustable brake on the reel.

8. A spinning machine as claimed in claim 6 wherein the means for moving the reel cyclically parallel to its length include a block connected to the reel, a guide parallel to the axis of the reel on which the block is adapted to slide, a rod parallel to the guide and having left hand and right hand threads formed in it and at least one means connecting the threads to the block.

9. A spinning machine as claimed in claim 8 wherein the means connecting the threads to the block include two tumbling half-nuts, one bearing a right hand thread and the other bearing a left hand thread, mounted on a plate pivotally connected to the block in such relative positions that either one of the half-nuts, but not both at once, make contact with the thread and means located at two predetermined points and adapted to cause the plate to pivot, whereby the block is driven in one direction parallel to the axis of the reel for a predetermined distance and the direction of movement is then reversed.

10. A spinning machine as claimed in claim 8 wherein the left and right hand threads on the rod are joined together at their two ends, whereby a continuous thread of cyclically reversing direction of movement is formed.

11. A spinning machine as claimed in claim 6 including a circumferential groove on the reel, a fork engaging in the groove and a rod attached to the fork and projecting from the second end of the cylinder, whereby an axial movement of the rod causes the reel to traverse axially.

* * * * *